United States Patent [19]

Tanaka et al.

[11] 4,116,556

[45] Sep. 26, 1978

[54] ELECTROPHOTOGRAPHIC COPYING APPARATUS

[75] Inventors: Susumu Tanaka, Sakai; Masaya Ogawa, Osaka; Hidetoshi Kawabata, Tondabayashi; Takao Fujiwara, Sakai; Takaji Kurita, Kawachinagano; Yuji Enoguchi, Osaka; Kenichi Wada; Hiroshi Murasaki, both of Sakai, all of Japan

[73] Assignee: Minolta Camera Kabushiki Kaisha, Osaka, Japan

[21] Appl. No.: 749,083

[22] Filed: Dec. 9, 1976

[30] Foreign Application Priority Data

Dec. 19, 1975 [JP] Japan ..... 50/152534

[51] Int. Cl.[2] ..... G03G 15/00; B65H 5/02

[52] U.S. Cl. ..... 355/3 SH; 271/273; 355/3 TR

[58] Field of Search ..... 355/3 R, 3 TR, 3 SH, 355/8, 11; 271/200, 273, 274

[56] References Cited

U.S. PATENT DOCUMENTS

| | | | |
|---|---|---|---|
| 3,450,402 | 6/1969 | Weiler | 271/80 |
| 3,689,146 | 9/1972 | Ito et al. | 355/11 X |
| 3,743,403 | 7/1973 | Sanza | 355/3 R |
| 3,957,368 | 5/1976 | Goshima et al. | 355/11 X |
| 4,017,169 | 4/1977 | Komura et al. | 271/273 |

*Primary Examiner*—Fred L. Braun

[57] ABSTRACT

An electrophotographic copying apparatus which is equipped with an improved arrangement for removing jammed copy paper. The apparatus is provided with a photoreceptor and a developing device combined into one unit which can be withdrawn to provide sufficient space for removing jammed copy paper, and is also provided with copy paper transporting members, a corona charger, a transfer charger, a copy paper separating claw etc. which can be moved away from a transfer section in one operation for facilitating access to the jammed copy paper in an efficient manner in the case of copy paper jamming. The transfer charger is covered when it is moved away from the transfer section to protect it from possible damage.

7 Claims, 5 Drawing Figures

ELECTROPHOTOGRAPHIC COPYING APPARATUS

Figure 1:
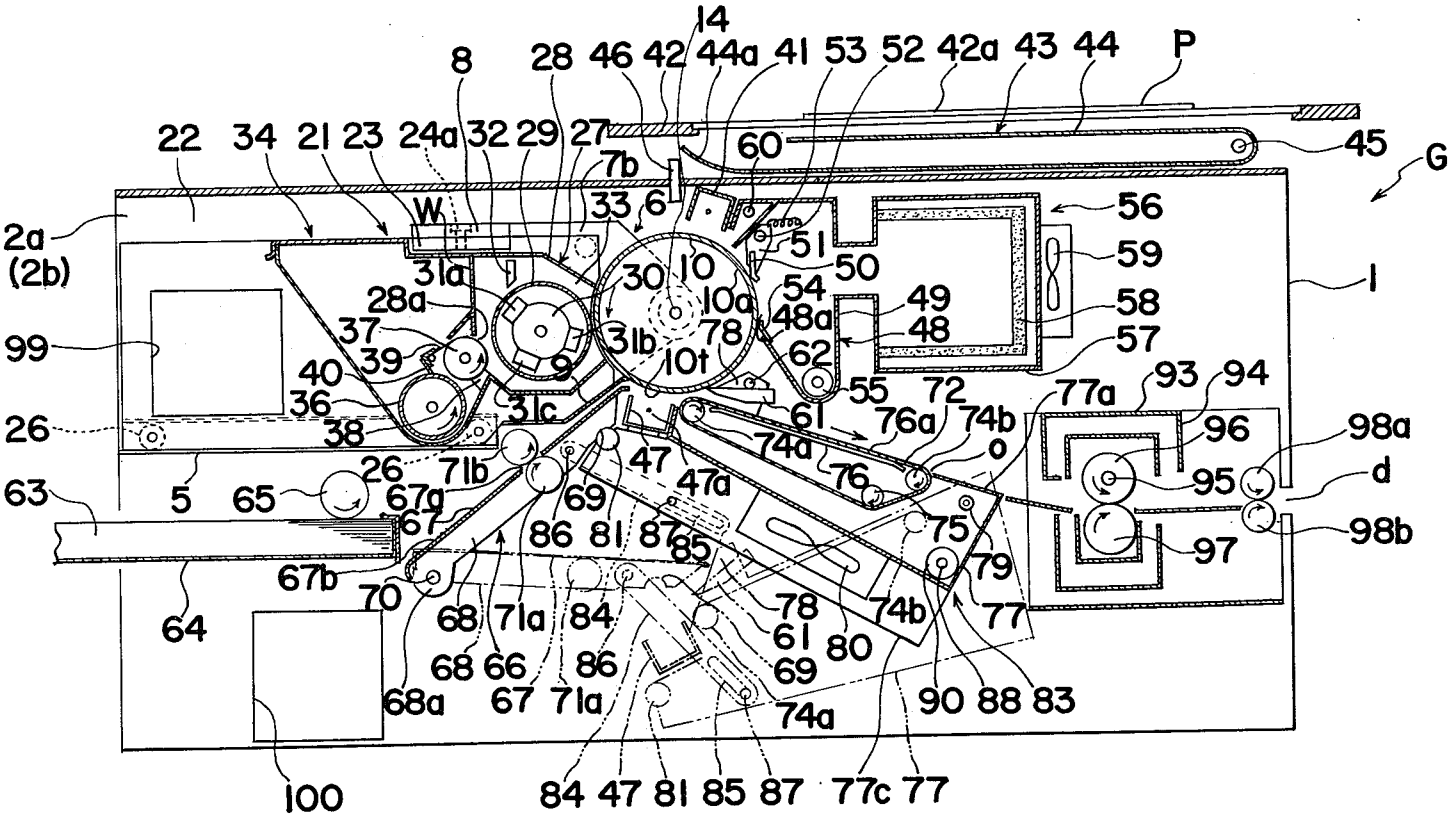

The present invention relates to an electrophotographic copying apparatus, and more particularly to an electrophotographic copying apparatus equipped with an improved removing arrangement for removing jammed copy paper.

Generally, in an electrophotographic copying apparatus, for example, of a type using the Carlson system, a photoreceptor in the form of a drum or the like is rotatably disposed in the central portion of the copying apparatus for forming thereon an electrostatic latent image of an original to be copied through an optical system which includes illuminating means for the original placed on a light transmitting platform at the upper portion of the copying apparatus, while a plurality of processing devices such as a corona charger for preliminarily charging the photoreceptor surface, a developing device for developing the latent image into a visible toner image, a transfer charger for transferring the toner image onto copy paper, a cleaning device for cleaning the photoreceptor surface after the transfer, etc. are sequentially disposed around the photoreceptor drum, and a fixing device for fixing the copied image onto the copy paper and copy paper feeding means for transporting copy paper from a copy paper storage toward a discharge outlet through the transfer device and the fixing device are disposed generally at the lower portion of the copying apparatus.

The electrophotographic copying apparatuses of the above described type tend to have troubles during operation resulting from copy paper jamming in the copy paper feeding means. The main causes of such troubles may be attributable to the fact that, owing to the difference in the paper quality, especially when using plain paper, it is rather difficult to separate the top sheets one by one from a stack of copy paper sheets in the copy paper storage in a stable manner for feeding the same into the paper feeding means, with the copy paper in some cases being fed slant-wise or a plurality of sheets being fed simultaneously, while the copy paper sheets tend to be unsuccessfully separated from the photoreceptor surface after close contact thereof with the photoreceptor surface for the transfer of the visible toner image onto such copy paper sheets. The frequent troubles due to copy paper jamming as described above are extremely difficult to prevent, since the copy paper sheets are readily affected by ambient temperatures and humidity. Since the majority of copy paper jamming takes place in the vicinity of the transfer station due to the unsuccessful separation of the copy paper sheet from the photoreceptor surface, it has been a conventional practice to axially withdraw the photoreceptor drum for removing the copy paper jammed in the copying apparatus. This procedure, however, is liable to damage the photoreceptor surface and for this reason is not a desirable way to remove jammed paper. Furthermore, in the event of copy paper jamming, the general method of removing the jammed copy paper has been to open only the portions of the transfer charger at portions where the jamming has occurred, for example, as disclosed in Japanese Utility Model publications Jitsukai-sho No. 49/55049 and Jitsukai-sho No. 49/55050, in which case, however, if it is not known where the jamming has taken place, access must be made according to the positions where jamming can occur along the copy paper transportation path, thus it being impossible to cope with the copy paper jamming in a rapid and efficient manner. Furthermore, should the copying apparatus be stopped, with the copy paper sheet being jammed between feeding rollers and the like disposed in the copy paper transportation path, it is extremely hard to remove the jammed copy paper, and thus there is a danger that the copy paper sheet will be torn or pieces of copy paper will enter the interior of the copying apparatus to cause malfunction of the latter.

Accordingly, an essential object of the present invention is to provide an electrophotographic copying apparatus equipped with an improved arrangement for removal of jammed copy paper in which the copy paper transporting means, a transfer charger, a copy paper separating claw and the like disposed in the vicinity of a transfer section of a photoreceptor are adapted, in association with each other, to be moved away from the transfer section for providing sufficient space for access therebetween in the event of copy paper jamming so as to facilitate removal of the jammed copy paper.

Another important object of the present invention is to provide an electrophotographic copying apparatus of the above described type in which the entire copy paper transporting path ranging from the copy paper storage to the fixing device can fully be opened up upon copy paper jamming for easy access to remove the jammed copy paper, while the photoreceptor and the developing device and formed in one unit for efficient positioning in and withdrawal from the copying apparatus housing.

A further object of the present invention is to provide an electrophotographic copying apparatus of the above described type in which, when the transfer charger is moved away from the photoreceptor for removal of the jammed copy paper, the copy paper transporting means is adapted to cover the transfer charger for the protection of the latter.

A still further object of the present invention is to provide an electrophotographic copying apparatus of the above described type which is accurate in functioning and simple in construction, with consequent reduction in manufacturing cost.

According to a preferred embodiment of the present invention, the electrophotographic copying apparatus is provided with a photoreceptor unit having a photoreceptor drum and a developing unit equipped with a developing device, with the photoreceptor and developing units being combined with each other to form one unit which can be withdrawn to one side of the copying apparatus housing for providing sufficient space in the copying apparatus to facilitate the removal of jammed copy paper upon occurrence of copy paper jamming, while components and devices in the vicinity of a transfer section such as the copy paper transporting means disposed adjacent to the transfer station of the photoreceptor drum, the transfer charger, the copy paper separating claw and the like are all adapted to be withdrawn from the transfer station in one operation through manipulation of a knob for ready access to the jammed copy paper in an efficient manner, with substantial elimination of the disadvantages inherent in the conventional copying apparatuses with respect to removal of jammed copy paper.

Figure 2:
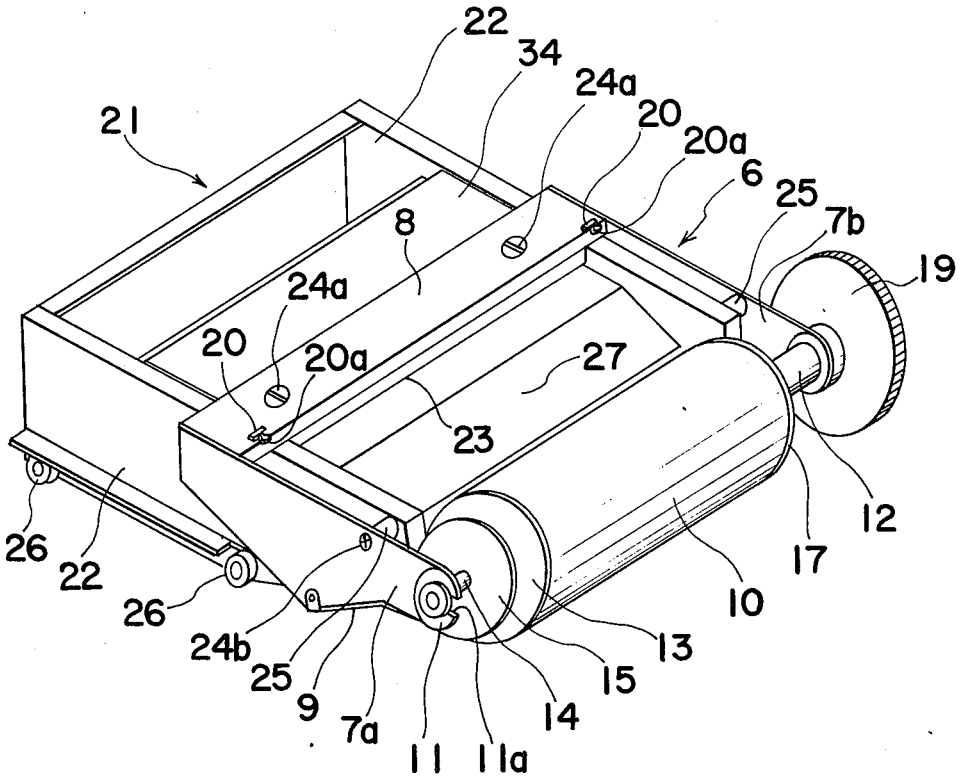
Figure 3:
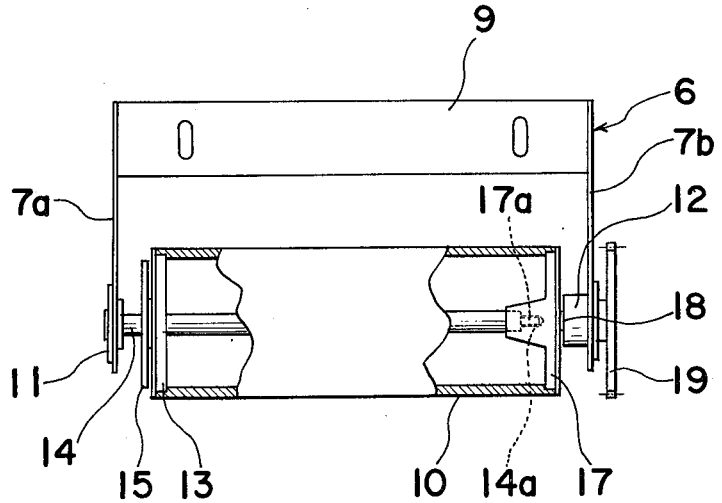
Figure 4:
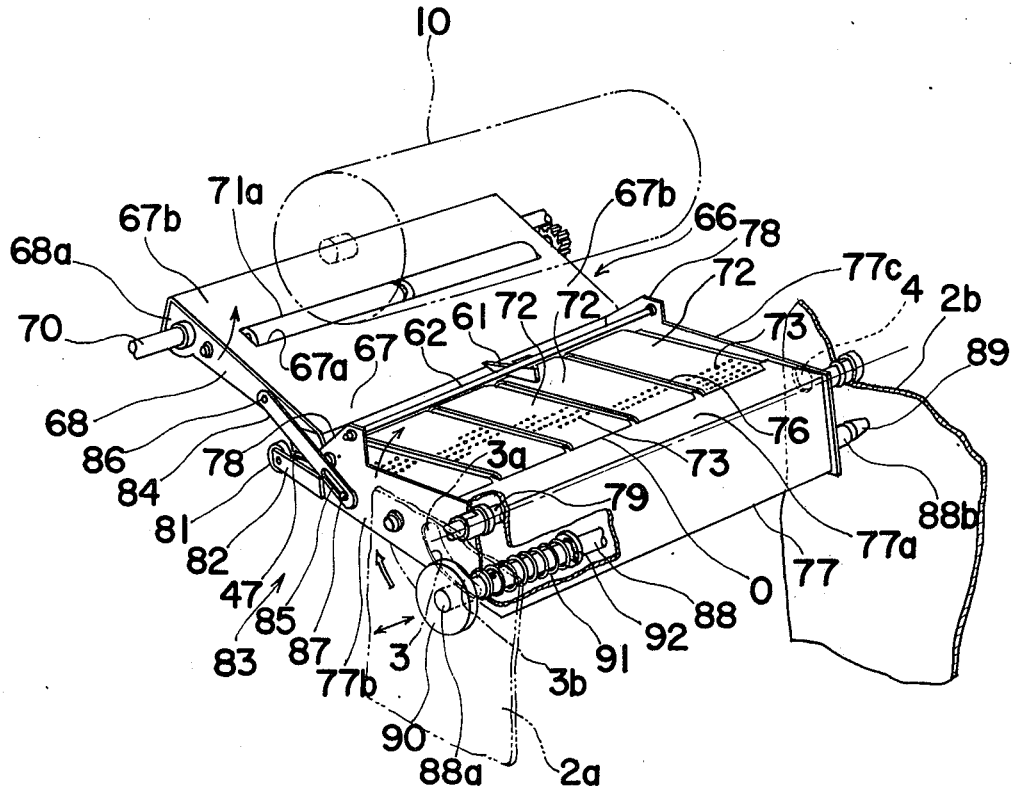
Figure 5:
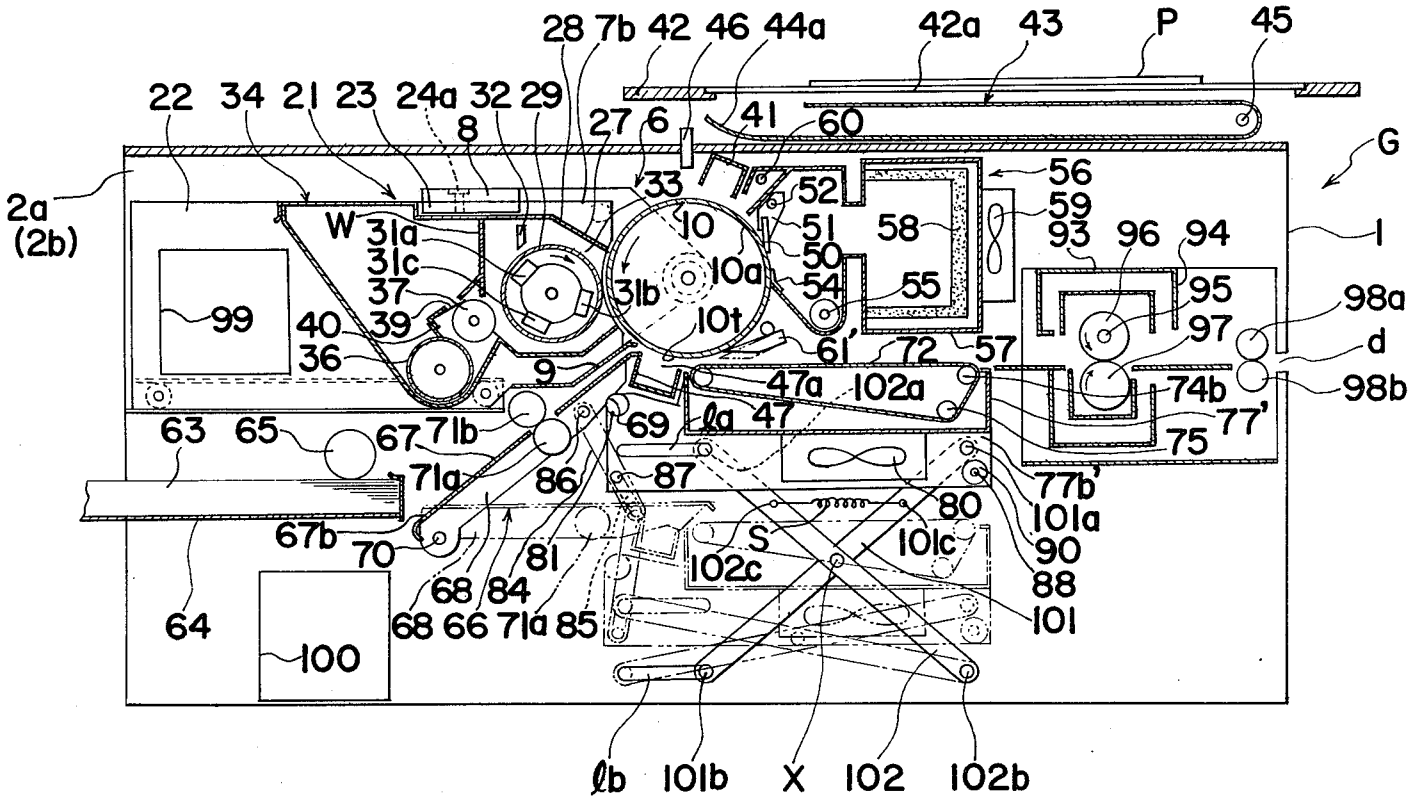

These and other objects and features of the present invention will become apparent from the following description taken in conjunction with the preferred embodiment thereof with reference to the attached drawings in which;

FIG. 1 is a schematic sectional side view of an electrophotographic copying apparatus according to one embodiment of the present invention, FIG. 2 is a perspective view showing an arrangement of a photoreceptor unit and a developing unit combined to form one unit and employed in the copying apparatus of FIG. 1, FIG. 3 is a top plan view, partly in section, of the photoreceptor unit of FIG. 2, with an upper plate of a frame work thereof and the developing unit removed for clarity, FIG. 4 is a perspective view showing spacing means for copy paper transporting means employed in the copying apparatus of FIG. 1, and FIG. 5 is a view similar to FIG. 1, but particularly shows a modification thereof.

Before the description of the present invention proceeds, it is to be noted that like parts are designated by like reference numerals throughout the several views of the accompanying drawing.

Referring now to FIGS. 1 to 4, there is shown in FIG. 1 a transfer type electrophotographic copying apparatus G according to one embodiment of the present invention which generally comprises a photoreceptor unit 6 including a photoreceptor drum 10 rotatably disposed at the central upper portion of the apparatus housing 1, a platform 42 for placing an original P to be copied on the light transmitting glass plate 42*a* thereof, which platform 42 is horizontally and reciprocatingly supported at the upper portion of the apparatus housing 1, an optical system 43 disposed between the platform 42 and the photoreceptor drum 6 and including an exposure lamp 45 and a known image transmitting optical fiber 46 for transmitting light images of the original P onto the photoreceptor drum 10 to form an electrostatic latent image of the original P on a photoconductive photoreceptor surface 10*a* of the drum 10, a corona charger 41 disposed above the photoreceptor drum 10 for preliminarily charging the photoreceptor surface 10*a*, a developing unit 21 having a developing device 27 and a toner dispenser 34 for developing the latent image of the original P into visible toner image and formed into one unit together with the photoreceptor unit 6 at the left hand portion of said unit 6, a transfer corona charger 47 disposed below the photoreceptor drum 10 for transferring the visible toner image onto a copy paper sheet 63, a cleaning device 48 provided with an air suction means 56 and disposed adjacent to the right hand side of the photoreceptor drum 10 for removing toner particles remaining on the photoreceptor surface 10*a* after the transfer, copy paper transporting means 66 disposed below the photoreceptor drum 10, a moving mechanism 83 for moving the transporting means 66 away from the drum 10, and a fixing device 93 disposed in the right hand lower portion of the housing 1 for fixing the transferred image onto the copy paper sheet 63.

The above described photoreceptor drum 10 includes a metallic cylindrical support member, for example, of aluminum, stainless steel and the like or a cylindrical support member of comparatively small diameter (60 to 100mm) which is made of plastic material or the like having a thin layer of aluminum, chromium, nickel etc. deposited or plated on its outer periphery, on which a thin layer of amorphous Se alloy containing, for example, Te by weight in an amount of 10 to 30%, or As by weight in an amount of 10 to 30%, or a ternary alloy containing both Te and As is vacuum evaporated to a thickness under 1 $\mu$, preferably to a thickness of approximately 0.5 $\mu$ as a photoconductive layer, with a semiconductor such as PVK (polyvinyl carbazole) being further applied onto the photoconductive layer to form thereon an endless layer 10 to 30 $\mu$ thick, preferably approximately 20 $\mu$ thick in a dry state. Alternatively, a single layer of amorphous Se alloy may be formed on the cylindrical support member as the photoconductive layer 10*a*.

It is to be noted here that, although a photoreceptor drum 10 of small diameter is described as being employed in the above embodiment for providing an electrophotographic copying apparatus of compact size, the size or configuration of the photoreceptor is not limited to that of the photoreceptor drum 10, but other types of photoreceptors different in size or configuration may be employed within the scope of the present invention.

Still referring to FIG. 1, the optical system 43 includes the exposure lamp 45 which is housed in an innermost portion of a reflecting shade 44 having a secondary curved surface, and the known light converging glass fiber image transmitter 46 disposed immediately above the photoreceptor drum 10. The image transmitter 46 as described above is disclosed, for example, in the U.S. Pat. No. 3,658,407 patented on Apr. 25, 1972 and therefore, reference may be made thereto for the details thereof. The light rays from the exposure lamp 45 converged by the secondary curved surface 44*a* of the shade 44 and reflected by the glass plate 42*a* of the platform 42 which scans from right to left on the apparatus housing 1 are directed onto the photoreceptor surface 10*a* through the image transmitter 46 for exposing the photoreceptor surface 10*a* preliminarily charged by the corona charger 41 to light images of the original P to be copied so as to form the latent image of the original P on said photoreceptor surface 10*a* in a known manner.

Referring particularly to FIGS. 2 and 3, the photoreceptor unit 6 having the photoreceptor drum 10 is provided with a frame work including a pair of side plates or walls 7*a* and 7*b*, spaced from each other, a fixing plate 8 connecting the plates 7*a* and 7*b* at the rear upper portions of the latter, and a guide plate 9 fixedly disposed between the forward lower edges of the plates 7*a* and 7*b* to form a passage for the copy paper sheet 63, while end plates 13 and 17 are fitted into corresponding open ends of the drum 10. One end plate 13 is rotatably mounted on a fixing shaft 14 journalled at one thereof in a bearing 11 provided at the forward end of the side plate 7*a*, with the other end plate 17 being secured to one end of a pin 18 extending through a bearing 12 fixed to the forward end of the side plate 7*b*, and by turning a handle plate 15 secured to the fixing shaft 14 adjacent to the end plate 13, an externally threaded portion 14*a* formed at the other end of the fixing shaft 14 is screwed into an internally threaded opening 17*a* formed in the inner central portion of the end plate 17 to secure the end plates 13 and 17 to the drum 10. A gear 19 is fixed to the other end of the pin 18 extending out of the side plate 7*b* so that the rotation of a motor 100 (FIG. 1) is transmitted through the gear 19 to the drum 10 to drive the same drum 10 counterclockwise in the direction indicated by an arrow in FIG. 1. For removing the photoreceptor drum 10, the handle plate 15 is rotated in a direction opposite to that as described above to disengage the externally threaded portion 14*a* of the shaft 14 from the internally threaded opening 17*a* of the end plate 17 and the shaft 14 is withdrawn through a notch 11*a* formed in the bearing 11 and the corresponding forward end of the side plate 7*a*.

Still referring to FIGS. 1 and 2, the developing unit 21 has a frame work composed of a pair of spaced side plates 22 and a fixing plate 23 connecting the plates 22 at the upper portions of the latter, in which frame work, there are accommodated the developing device 27, the toner dispenser 34 and the motor 99 (FIG. 1) for driving said developing device 27 and toner dispenser 34. The developing unit 21 is integrally connected to the photoreceptor unit 6 by a pair of securing screws 24*a* threaded into the fixing plate 23 of the unit 21 through the fixing plate 8 of the photoreceptor unit 6 and also by another pair of securing screws 24*b* threaded into the side plates 22 of the developing unit 21 through the side plates 7*a* and 7*b* of the photoreceptor unit 6 and corresponding pair of spacers 25 disposed between the plates 22 and the plates 7. At the lower forward portions and lower rear portions of the side plates 22, there are rotatably mounted four moving rollers 26 for rotation on a pair of guide rails 5 (FIG. 1) secured to the frames 2*a* and 2*b* of the apparatus housing 1, by which arrangement, the units 6 and 21 can selectively be housed into or withdrawn from the apparatus housing 1 in an efficient manner. Furthermore, a pair of fixing metal pieces 20 each having projections 20*a* thereon are fixed on the surface adjacent to opposite sides of the fixing plate 8 of the photoreceptor unit 6, while a corresponding pair of retaining metal pieces (not shown) are secured to the frames (not shown) of the apparatus housing 1 for elastically holding the fixing metal pieces 20 under pressure, and thus when the units 6 and 21 in one unit are inserted into the apparatus housing 1, the projections 20*a* of the metal pieces 20 are brought into engagement with the retaining metal pieces under pressure to hold the photoreceptor drum 10 and its associated devices precisely in predetermined positions.

Referring particularly to FIG. 1, the developing device 27 housed in the frame work of the developing unit 21 as described above includes an outer cylinder 29 made of nonmagnetic material rotatably disposed in a casing 28 for rotation clockwise in FIG. 1, while a plurality of permanent magnets 31*a*, 31*b* and 31*c* are fixedly mounted on a stationary support member 30 axially disposed within the outer cylinder 29, with a doctor blade 32 being provided above and adjacent to the outer cylinder 29. Developing material composed of magnetizable carrier material of fine spherical shape and electroscopic toner particles is attracted onto the outer periphery of the outer cylinder 29 mainly by the action of the magnetic field of the magnet 31*a* and transported upwardly as the outer cylinder 29 rotates, with the amount of the developing material transported being restricted by the presence of the doctor blade 32, and then temporarily pooled in a state free from the action of the magnetic field of the magnet 31*a*, in the developing material sump 33 formed between the photoreceptor drum 10 and the outer cylinder 29 for subsequently being cascaded over the photoreceptor surface 10*a* of the photoreceptor drum 10 to develop the latent image preliminarily formed on said photoreceptor surface 10*a*. The developing material after the development operation is restricted in its movement by the magnetic field of the magnets 31*b* and 31*c* and further transported as the outer cylinder 29 continues to rotate clockwise.

The toner dispenser 34 includes a toner tank 35 having a supply roller 36 and a replenishing roller 37 rotatably disposed adjacent to a bottom portion of said toner tank 35 for respective counterclockwise rotation. As the rollers 36 and 37 rotate, toner particles housed in the toner tank 35 are fed into the developing device 27 through an opening or slot 28*a* formed between a lower edge of a partition wall *w* and the outer periphery of the replenishing roller 37, while a toner quantity restricting pad 38 and a scraping blade 39 are disposed adjacent to the roller 37, with a toner restricting plate 40 being provided in the vicinity of the supply roller 36.

The cleaning device 48 communicated with the air suction means 56 includes a casing 49 provided with an opening 48*a* adjacent to the photoreceptor surface 10*a*, a blade 50 of abrasion resistant elastic member made, for example, of rubber, polyurethane and the like and adapted to normally contact the photoreceptor surface 10*a* for removing residual toner particles from said surface 10*a* through sliding movement therebetween, and a spirally grooved roller 55 for toner collection rotatably disposed adjacent to the bottom of the casing 49. The blade 50 is secured to the lower edge of a support plate 51 which is pivotally connected at its upper portion to the side wall of the casing 49 by a pin 52 and is normally urged clockwise about the pin 52 by spring means 53 connected between the upper edge of the plate 51 and the side wall of the casing 49 to cause the blade 50 to contact the photoreceptor surface 10*a*. Along the lower edge of the opening 48*a*, a resilient plate 54, for example, of Mylar is mounted so as to lightly contact the photoreceptor surface 10*a* for preventing the residual toner removed by the blade 50 from leaking out of the casing 49. The residual toner particles scraped off the surface 10*a* fall into the bottom of the casing 49 by gravity and are transported in the axial direction of the spirally grooved roller 55 as the roller rotates for subsequently being collected in a toner sump (not shown).

The air suction means 56 mounted at the back of the cleaner 48 has a casing 57 communicated with the casing 49 of the cleaner 48, which casing 57 is provided with a filter bag 58 disposed along the inner walls of the casing 57 and a suction fan 59 mounted at the back of said casing 57. Upon rotation of the fan 59 by suitable driving means (not shown), air containing floating toner particles within the casings 49 and 57 is drawn through the filter bag 58, with the toner particles being caught by said filter bag, and thus leakage of the toner particles out of the cleaning device 48 is advantageously prevented.

Additionally, at the upper portion of the casing 49 of the cleaning device 48, there is disposed an eraser lamp 60 for projecting light onto the photoreceptor surface 10*a* to remove residual charge therefrom.

Meanwhile, the copy paper sheets 63 mounted in a stack on a tray 64 are fed one sheet by one sheet from the top of the stack as a copy paper feeding roller 65 in contact with the top sheet rotates.

Referring particularly to FIGS. 1 and 4, the copy paper transporting means 66 associated with a moving means 83 which is directly related to the present invention generally includes a guide plate 67 for guiding a copy paper sheet 63 from the tray 64 to a transfer section 10*t* of the photoreceptor surface 10*a*, transportation rollers 71*a* and 71*b* rotatably disposed along the path of the copy paper sheet 63 through an elongated opening 67*a* formed in the guide plate 67, and a plurality of transportation belts 72 for transporting the copy paper sheet 63 from the transfer section 10*t* to the fixing device 93 mentioned later.

The guide plate 67 having a flat surface 67*b* for the path of the copy paper sheet 63 has a pair of side walls 68 extending downwardly at right angles from opposite side edges of the flat surface 67*b* thereof, and the side walls 68 are pivotally connected, at end portions 68*a* thereof adjacent to the copy paper tray 64, to frames (not shown) of the apparatus housing 1 by a shaft 70 and simultaneously urged clockwise by spring means (not shown). The copy paper transporting roller 71*a* is rotatably mounted on the side walls 68 of the guide plate 67, with part of the outer periphery of the roller 71*a* extending through the elongated opening 67*a* of the plate 67 for engagement with the mating roller 71*b* which is also rotatably mounted on the frames 2*a* and 2*b* of the apparatus housing 1.

The endless transportation belts 72 are supported for movement in a direction shown by an arrow in FIG. 1 by rollers 74*a* and 74*b*, and a tension roller 75 which are rotatably mounted on a casing 77, and each have formed over the entire surface numerous small suction openings 73 as shown in FIG. 4. The forward run or upper portion of each of the belts 72 between the rollers 74*a* and 74*b* is exposed through a corresponding opening O formed in an upper plate 77*a* of the casing 77, while a guide plate 76 provided with small openings 76*a* is disposed along the back surface of each of the belts 72. At the lower portion of the casing 77 in a position below the belts 72, there is disposed a suction fan 80 for drawing the belts 72 onto the guide plates 76 to maintain the belts 72 in a flat state and also for drawing the copy paper sheet 63 against the upper surface of the belts 72 so as to transport the copy paper sheet 63 by the movement of the belts 72. The casing 77 further including side walls 77*b* and 77*c* is pivotally connected, in positions adjacent to the right upper corners of the walls 77*b* and 77*c*, to the frames 2*a* and 2*b* of the apparatus housing 1 by a shaft 79 located adjacent to the fixing device 93, with the transfer charger 47 being mounted on the forward end portion of the casing 77 adjacent to the photoreceptor surface 10*a*. A shaft 62 to which a copy paper separating claw 61 is secured is rotatably supported between projections 78 extending upwardly from the side walls 77*b* and 77*c* in positions adjacent to the roller 74*a*. The above described guide plate 67 and the transportation belt 72 are adapted to be moved away from the transfer section 10*t* of the photoreceptor drum 10 by pivotal movement of the former about respective axes 70 and 79, for which purpose, there is further provided moving means 83 including a connecting lever 84, and a shaft 88 provided with a knob 90 as described hereinbelow. More specifically, the connecting lever 84 is pivotally connected at one end thereof to the side wall 68 of the guide plate 67 by a pin 86, while an elongated opening 85 formed at the other end of the lever 84 slidably receives a pin 87 secured to the side wall 77*b* of the casing 77. The shaft 88 extending transversely through the side walls 77*b* and 77*c* of the casing 77 in a position adjacent to the shaft 79 is provided with the knob 90 at one end 88*a* thereof projecting out of an arcuate guide opening 3 formed in the frame 2*a* of the apparatus housing 1, while the other end 88*b* thereof extending through the other side wall 77*c* is gradually narrowed to a tapered end as shown in FIG. 4, with an annular groove 89 being formed in the end 88*b* in a position adjacent to its extremity. The shaft 88 is further provided with a compression spring 91 mounted on the outer periphery of the shaft 88 between the side wall 77*b* and a retaining ring 92 for normally being urged toward the frame 2*b* of the apparatus housing 1. When the casing 77 is pivoted toward the photoreceptor drum 10 about the pivotal shaft 79 (i.e., toward the normal position during the copying operation as indicated by the full lines in FIG. 1), the end 88*b* of the shaft 88 is pushed into a locking opening 4 (FIG. 4) formed in the frame 2*b* of the apparatus housing for engagement of the groove 89 with peripheral edge of the locking opening 4, and thus the casing 77 and consequently the belts 72 are correctly positioned in their operating positions. In the above state, the end 88*a* of the shaft 88 is located at the upper portion 3*a* of the arcuate guide opening 3 formed in the frame 2*a* of the apparatus housing 1, with the guide plate 67 being correctly positioned simultaneously by the engagement of a roller 81 which is rotatably supported by a bracket 82 secured to the forward portion of the casing 77 with a corresponding recess 69 (FIG. 1) formed in the side wall 68 of the guide plate 67.

For moving the guide plate 67 and the transportation belt 72 away from the transfer section 10*t* of the photoreceptor drum 10, the knob 90 is first pulled toward the operator to cause the shaft 88 to slide in the same direction against the urging force of the coil spring 91 for releasing the groove 89 of the shaft 88 from the engagement thereof with the locking opening 4. Subsequently, when the knob 90 is moved slantwise downwardly, while being pulled toward the operator, the shaft 88 is moved along the arcuate guide opening 3 from its upper portion 3*a* to the lower portion 3*b*, and following such movement of the shaft 88, the casing 77 is pivoted counterclockwise about the shaft 79 to the lowered position, while the guide plate 67 is also rotated clockwise about the shaft 70 by the urging force of spring means (not shown) so as to be moved to a position spaced from the transfer section 10*t* as shown in chain lines in FIG. 1. During the movement in the above described manner, the guide plate 67, at the initial stage of its pivotal movement, is supported by the roller 81 mounted on the casing 77 and engaging the recess 69 in the side wall 68, but the plate 67 is released from the engagement with the roller 81 immediately thereafter and is subsequently subjected to clockwise pivotal movement, while being supported by the connecting lever 84. Meanwhile, the transfer charger 47 and the copy paper separating claw 61 coupled to the casing 77 are simultaneously moved downward together with the casing 77 following the counterclockwise movement of said casing 77 to be moved away from the transfer section 10*t* of the photoreceptor drum 10, with the opening 47*a* of the transfer charger 47 being advantageously covered by the forward end portion of the guide plate 67 for being protected against contact with other objects.

Still referring to FIG. 1, the fixing device 93 provided at the right hand portion of the apparatus housing 1 in a position subsequent to the transportation belts 72 includes a casing 94 in which a heat roller 96 incorporating therein a heating element 95 and a corresponding pressing roller 97 contacting the roller 96 are rotatably disposed, and a pair of discharge rollers 98*a* and 98*b* are also rotatably disposed in the path of the copy paper sheets 63 adjacent to a copy paper discharge outlet *d* formed in the apparatus housing 1.

In the electrophotographic copying apparatus of FIG. 1, the developing device 27 and the toner dispenser 34 are driven by the motor 99, while the photoreceptor drum 10, the platform 42, the transportation belts 72, etc. are driven by the motor 100.

In the above arrangement, the copying processes of the electrophotographic copying apparatus of FIG. 1 are similar to those of the conventional copying apparatuses except for the inclusion of the copy paper transporting means 66 associated with the moving means 83. More specifically, the photoreceptor surface 10*a* of the photoreceptor drum 10 which is rotated counterclockwise is preliminarily charged by the corona charger 41 through corona discharge therefrom having a polarity corresponding to the charging characteristics of the photoconductive photoreceptor layer, and subsequently exposed, through the optical system 43, to light images of the original P placed on the glass plate 42*a* of the platform 42 which scans at the same speed as the rotational speed of the photoreceptor drum 10 to form on the photoreceptor surface 10*a* the electrostatic latent image of the original P. The latent image which is then developed into the visible toner powder image through cascading of the developing material thereover at the developing device 27 reaches the transfer section 10*t* as the photoreceptor drum 10 further rotates. Meanwhile, the copy paper sheets 63 fed one by one from the stack on the tray 64 are gripped between the transportation rollers 71*a* and 71*b* to be further forwarded to the transfer section 10*t*, in synchronization with the arrival thereat of the toner image on the photoreceptor surface 10*a*, through the space between the guide plate 67, and the guide plate 9 of the photoreceptor unit 6. Subsequently, the toner image on the photoreceptor surface 10*a* is transferred onto the copy paper sheet 63 through corona discharge by the transfer charger 47. The copy paper sheet 63 having the toner image thereon is separated, at its leading edge, from the photoreceptor surface 10*a* by the copy paper separating claw 61 and is further transported, while being drawn onto the surface of the transportation belts 72, to the fixing device 93, whereat the toner image is fixed onto the copy paper sheet 63 through fusion of the toner by the heat roller 96, after which, the copy paper sheet is discharged out of the apparatus housing 1 onto a tray (not shown) through the discharge rollers 98*a* and 98*b* and the discharge outlet *d*.

Should copy paper jamming take place at the transfer section 10*t*, for example, by faulty separation of the copy paper sheet by the separating claw 61 or the like, the jammed copy paper sheet can readily be removed by simultaneously moving the guide plate 67, the transportation belts 72, the transfer charger 47, and the separating claw 61 away from the transfer section 10*t* of the photoreceptor drum 10 through operation of the knob 90 in the above described manner. Furthermore, in the embodiment of FIGS. 1 to 4, since the photoreceptor drum 10, the developing device 27 and the toner dispenser 34 are integrally formed as one unit which can be drawn out toward the left in FIG. 1 by rotation of the moving rollers 26 along the guide rails 5, a large space is formed in a position normally occupied by the photoreceptor drum 10 when the photoreceptor unit 6 is withdrawn together with the developing unit 21 in the event of copy paper jamming, and thus not only is removal of copy paper jammed at the portion of the cleaning device 48 facilitated to a large extent, but the danger of damaging the photoreceptor surface 10*a* is completely prevented. Furthermore, since the photoreceptor drum 10 is completely drawn out to the side of the apparatus housing 1, the disadvantages in the conventional arrangements that the shaft for the photoreceptor drum is used for a guide member for insertion and withdrawal of the drum even after the drum has been drawn out and gives rise to inconveniences for replacing, for example, the blade 50 of the cleaning device 48 are advantageously eliminated. Additionally, due to the fact that the photoreceptor drum 10 and the developing device 27 are fixed in predetermined positions relative to each other as one unit at the outside of the apparatus housing 1, extremely accurate positioning can be achieved therebetween and also with respect to other processing devices within the copying apparatus, thus making it unnecessary to effect positioning between the photoreceptor drum 10 and the developing device 27 each time the photoreceptor drum has been drawn out of the apparatus housing 1.

As is clear from the foregoing description, according to the electrophotographic copying apparatus of the present invention, since the copy paper sheet transporting means disposed in the vicinity of the transfer section of the photoreceptor drum, the transfer charger, and the copy paper separating claw are associated with each other for being moved away from the transfer section, components in the neighborhood of the transfer section are all moved simultaneously in one operation, and thus the removal of jammed copy paper around the transfer section is greatly facilitated. Furthermore, the arrangement that the transfer charger 47 is covered by the guide plate 67 when the transfer charger is spaced away from the transfer section is particularly effective for protecting the charger 47 from possible damage during the removal of the jammed copy paper.

Referring now to FIG. 5, there is shown a modification of the electrophotographic copying apparatus of FIGS. 1 to 4. In this modification, the casing 77 for the transportation belts 72, previously described as pivotally connected, through the side plates 77*b* and 77*c* thereof, to the frames 2*a* and 2*b* of the apparatus housing 1 by the shaft 79, is replaced by a casing 77' which is adapted to move vertically in parallel relation with the platform 42, while the guide plate 67 having a similar construction to that in FIGS. 1 to 4 is adapted to follow the movement of the casing 77' through pivotal movement of said plate 67 about the shaft 70. It is to be noted that, in this modification, the copy paper separating claw 61 described as mounted on the forward end portion of the casing 77 in the embodiment of FIGS. 1 to 4 is replaced by a similar copy paper separating claw 61' pivotally connected to the frames (not shown) of the apparatus housing 1. The casing 77' is movably supported by support bars 101 and 102 which are pivoted to each other at the central portions thereof by a pin X, with the upper end of the bar 101 being pivotally connected to one end portion of the casing 77' by a pin 101*a* and the lower end of the same bar 101 being slidably received by a pin 101*b* secured thereto in an elongated opening *lb* formed in a frame (not shown) of the apparatus housing 1, while the upper end of the bar 102 is also slidably received, by a pin 102*a* secured thereto, in an elongated opening *la* formed at the other end portion of the casing 77', with the lower end of the same bar 102 being pivotally connected to a corresponding frame (not shown) of the apparatus housing 1 by a pin 102*b*. The casing 77' can be fixedly set at the position shown in full lines in FIG. 5 by the engagement of the annular groove 89 formed in the end 88*b* of the shaft 88 with the locking opening 4 provided in the frame 2*b* of the apparatus housing 1 as described in detail with reference to FIG. 4 of the first embodiment. Upon occurrence of copy paper jamming, when the end 88*b* of the shaft 88 is disengaged from the opening 4 by manipulating the knob 90, the casing 77' while being held approximately horizontal is lowered vertically downward by gravity to a position shown by chain lines in FIG. 5 as the support bars 101 and 102 are rotated away from each other about the pivotal point X, in which case, since the connecting lever 84 is connected at the one end thereof to the side wall 68 of the guide plate 67 by the pin 86 and slidably receives, through the elongated opening 85 formed at its other end, the pin 87 secured to the side wall 77*b'* of the casing 77', the guide plate 67 of the transporting means 66 is turned clockwise to the lowered position away from the transfer section 10*t* about its pivotal connection or pin 70 in a similar manner to that described with reference to FIG. 4, with the guide plate 67 covering the transfer charger 47 for protecting the latter against damage such as breaking of the corona wire thereof or the like. After the jammed copy paper has been removed, as the casing 77' is raised, the guide plate 67 is also raised through the connecting lever 84, and subsequently secured at the position shown by the full lines by the engagement of the end 88*b* of the shaft 88 with the locking opening 4 in the above described manner. The copy paper separating claw 61' pivotally mounted on the sides of the frames 2*a* and 2*b* of the apparatus housing 1 in this modification is adapted to be slightly moved from the photoreceptor surface 10*a* to a position shown in dotted lines in FIG. 5 as the casing 77' is vertically moved. The provision of the separating claw 61' mounted on the apparatus housing side unlike that of the claw 61 in the casing 77 as in the first embodiment is effective for facilitating the removal of the jammed copy paper without any obstruction.

It is to be noted here that, although in the modification of FIG. 5, the casing 77 is adapted to be lowered by gravity, spring means S or the like may further be connected between pins 101*c* and 102*c* secured to the bars 101 and 102 as shown in FIG. 5 for balancing purposes to reduce the weight acting on the hands of the operator during lowering of the casing 77'.

It should also be noted that spring force of such spring means S may be increased so as to be greater than the force of the gravity to urge the casing 77' to move upwardly, with stopping means (not shown) being provided to cause the casing 77' to stop at the position shown by the full lines, so that the casing 77' is depressed, upon copy paper jamming, down to the position shown by the dotted lines whereat the casing 77' is held by suitable lock means (not shown) which is released, after removal of the jammed copy paper, to cause the casing 77' to be returned to the position shown by the full lines. For the locking means for locking the casing 77' in position, besides the opening 4 and the shaft end 88*b* or other pin-like member engageable with a locking opening as in the above embodiment, modifications thereof or other semi-fixing means such as known magnet catches or roller catches in which a spade-like member is pressed between a pair of balls and the like suitably urged toward each other may be employed so far as these serve the purpose for selectively locking and releasing the casing 77' in an efficient manner.

It should further be noted that in the above embodiments, although the present invention is mainly described with reference to the transfer type electrophotographic copying apparatus, the concept of the present invention is not limited, in its application, to such transfer type copying apparatus, but is applicable to any other type of copying apparatus wherein moving of the transporting path of the copy paper away from corresponding processing devices is necessary for providing sufficient space to facilitate the removal of jammed copy paper.

Although the present invention has been fully described by way of example with reference to the attached drawings, it is to be noted that various changes and modifications will be apparent to those skilled in the art. Therefore, unless such changes and modifications depart from the scope of the present invention, they should be construed as being included therein.

What is claimed is:

1. In an electrophotographic copying apparatus which has at least a movable photoreceptor member having a photoreceptor layer disposed on an outer periphery thereof, corona charging means for preliminarily charging said photoreceptor surface, means for exposing said preliminary charged photoreceptor surface to light images of an original to be copied so as to form images corresponding to said original on said photoreceptor surface as said photoreceptor member moves, means for transferring said images corresponding to said original onto said transfer material, and means for fixing said images corresponding to said original onto said transfer material for obtaining copied images of said original on said transfer material, the improvement which comprises:

a first transporting means for transporting said transfer material from a feeding means against said photoreceptor surface and between said photoreceptor surface and said transferring means and having an elongated transfer material supporting means extending toward said photoreceptor surface, said first transporting means being pivotally mounted at the end remote from said photoreceptor surface and having a free end adjacent said photoreceptor surface retractable away from and movable toward said photoreceptor surface;

a second transporting means for transporting said transfer material from between said photoreceptor surface and said transferring means to said fixing means and having an elongated transfer material supporting means extending away from said photoreceptor surface, said second transporting means being pivotally mounted at the end remote from said photoreceptor surface and having a free end adjacent said photoreceptor surface retractable away from and movable toward said photoreceptor surface, said first and second transporting means being associated with each other for forming a path for the transfer material from said feeding means to said fixing means; and connecting means connecting said first transporting means with said second transporting means for moving the free ends of said first and second transporting means in association with each other during retraction from said photoreceptor surface for providing space along said path of said transfer material within said copying apparatus for facilitation of removal of jammed transfer material.

2. In an electrophotographic copying apparatus which has at least a movable photoreceptor member having a photoreceptor layer disposed on an outer periphery thereof, corona charging means for preliminarily charging said photoreceptor surface, means for exposing said preliminary charged photoreceptor surface to light images of an original to be copied so as to form images corresponding to said original on said photoreceptor surface as said photoreceptor member moves, means for transferring said images corresponding to said original onto a transfer material including a transfer charger having an opening directed toward said photoreceptor member, and means for fixing said images corresponding to said original onto said transfer material for obtaining copied images of said original on said transfer material, the improvement which comprises:

a first transporting means for transporting said transfer material from a feeding means against said photoreceptor surface and between said photoreceptor surface and said transferring means, said first transporting means being movably disposed with respect to said photoreceptor surface for being retracted from and movable toward said photoreceptor surface;

a second transporting means for transporting said transfer material from between said photoreceptor surface and said transferring means to said fixing means, said second transporting means also being movably disposed with respect to said photoreceptor surface for being retracted from and movable toward said photoreceptor surface, said first and second transporting means being associated with each other for forming a path for the transfer material from said feeding means to said fixing means; and connecting means connecting said first transporting means with said second transporting means for moving said first and second transporting means in association with each other during retraction from said photoreceptor surface for providing space along said path of said transfer material within said copying apparatus for facilitation of removal of jammed transfer material said transfer charger being integrally formed with one of said first and second transporting means, said first and second transporting means being associated with each other for moving the other of said transporting means to cover the opening of said transfer charger when said first and second transporting means are retracted from said photoreceptor surface, whereby said transfer charger is protected from possible damage during the removal of jammed transfer material.

3. An electrophotographic copying apparatus as claimed in claim 2, wherein said transfer charger is formed integrally with said second transporting means and is covered by said first transporting means when retracted.

4. An electrophotographic copying apparatus as claimed in claim 2, wherein said first transporting means is pivotally disposed about an axis adjacent to said feeding means, said second transporting means is pivotally disposed about an axis adjacent to said fixing means, and said connecting means is pivotally and slidably connected between the portions of said first and second transporting means which are adjacent to each other, said first and second transporting means leaving a space between said photoreceptor surface and said transfer charger when said first and second transporting means are retracted together from said photoreceptor surface, whereby removal of jammed transfer material positioned between said photoreceptor surface and said transfer charger is facilitated.

5. An electrophotographic copying apparatus as claimed in claim 2, wherein said first transporting means is pivotally disposed about an axis adjacent to said feeding means, said second transporting means is movably disposed for movement toward and away from said photoreceptor surface with said second transporting means remaining parallel with said path formed by said second transporting means when said second transporting means is adjacent said photoreceptor surface, and said connecting means being pivotally and slidably connected between the portions of said first and second transporting means which are adjacent to each other for retracting said first and second transporting means from said photoreceptor surface together.

6. In an electrophotographic copying apparatus which has a rotary photoreceptor member having a photoreceptor layer formed on the outer periphery thereof, corona charging means for preliminarily charging said photoreceptor surface, means for exposing said preliminarily charged photoreceptor surface to light images of an original to be copied through light ray transmitting means so as to form an electrostatic latent image of said original on said photoreceptor surface as said photoreceptor member rotates, means for developing said electrostatic image formed on said photoreceptor surface into a visible toner image, means for feeding transfer material, a transfer charger disposed in a position adjacent to said photoreceptor surface and having an opening directed toward said photoreceptor surface for transferring said visible toner image on said photoreceptor surface onto said transfer material, and means for fixing said visible toner image transferred onto said transfer material to said transfer material for obtaining a copied image of said original on said transfer material, the improvement which comprises:

a first transporting means pivotally disposed in a position between said feeding means and said transfer charger about a pivotal axis adjacent said feeding means for pivotal movement about said axis away from said photoreceptor surface, said first transporting means including a transporting roller and a mating roller associated therewith and rotatably mounted on said apparatus for transporting said transfer material against said photoreceptor surface and between said photoreceptor surface and said transfer charger;

a second transporting means including a transportation belt member for transporting said transfer material to said fixing means and pivotally disposed in a position between said transfer charger and said fixing means about a pivotal axis adjacent said fixing means for pivotal movement about said axis away from said photoreceptor surface, said transportation belt member having a plurality of small openings therein and having rotatable roller members on which said belt members are movably supported and suction means coupled to said belt member, said transfer charger being integrally formed with said second transporting means and the opening of said transfer charger being covered by said first transporting means when said first and second transporting means are retracted from said photoreceptor surface, said first and second transporting means being associated with each other for forming a path for the transfer material from said feeding means to said fixing means; and connecting means connecting said first and second transporting means for causing said first and second transporting means to be moved together when they are pivotally moved away from said toward said photoreceptor member in association with each other for providing space along the entire path of said transfer material from said feeding means to said fixing means for facilitation of removal of jammed transfer material.

7. In an electrophotographic copying apparatus which has a rotary photoreceptor member having a photoreceptor layer formed on the outer periphery thereof, corona charging means for preliminarily charging said photoreceptor surface, means for exposing said preliminarily charged photoreceptor surface to light images of an original to be copied through light ray transmitting means so as to form an electrostatic latent image of said original on said photoreceptor surface as said photoreceptor member rotates, means for developing said electrostatic latent image formed on said photoreceptor surface into a visible toner image, means for feeding transfer material, a transfer charger disposed in a position adjacent to said photoreceptor surface and having an opening directed toward said photoreceptor surface for transferring said visible toner image on said photoreceptor surface onto said transfer material, and means for fixing said visible toner image transferred onto said transfer material to said transfer material for obtaining a copied image of said original on said transfer material, the improvement which comprises:

a first transporting means pivotally disposed in a position between said feeding means and said transfer charger about a pivotal axis adjacent said feeding means for pivotal movement about said axis away from said photoreceptor surface, said first transporting means including a transporting roller and a mating roller associated therewith and rotatably mounted on said apparatus for transporting said transfer material against the photoreceptor surfae and between said photoreceptor surface and said transfer charger;

a second transporting means including a transportation belt member for transporting said transfer material to said fixing means and movably disposed in a position between said transfer charger and said fixing means, said second transporting means being movable away from and toward said photoreceptor surface while remaining parallel with the transporting path formed by said second transporting means for transporting said transfer material, said transportation belt member having a plurality of small openings therein and having rotatable roller members on which said belt members are movably supported and suction means coupled to said belt member, said transfer charger being integrally formed with second transporting means and the opening of said transfer charger being covered by said first transporting means when said first and second transporting means are retracted from said photoreceptor surface, said first and second transporting means being associated with each other for forming a path for the transfer material from said feeding means to said fixing means; and connecting means connecting said first and second transporting means for causing said first and second transporting means to be moved together when they are pivotally moved away from and toward said photoreceptor member in association with each other for providing space along the entire path of said transfer material from said feeding means to said fixing means for facilitation of removal of jammed transfer material.

* * * * *